United States Patent [19]

Fujiu et al.

[11] 4,392,265

[45] * Jul. 12, 1983

[54] METHOD OF MODIFYING THE DYE AFFINITY OF CELLULOSE FIBER-CONTAINING STRUCTURE WITH BENZENE SULFONYL CHLORIDE

[75] Inventors: Takahiro Fujiu, Funabashi; Masao Nakajima, Tokyo; Shigeru Okano, Musashino, all of Japan

[73] Assignee: Toppan Printing Co., Ltd., Japan

[ * ] Notice: The portion of the term of this patent subsequent to Sep. 1, 1998, has been disclaimed.

[21] Appl. No.: 320,763

[22] Filed: Nov. 12, 1981

[30] Foreign Application Priority Data

Jun. 15, 1981 [JP] Japan ..... 56-92043
Jun. 19, 1981 [JP] Japan ..... 56-94925

[51] Int. Cl.[3] ..... C09B 62/00; D06P 5/22

[52] U.S. Cl. ..... 8/120; 8/129; 8/444; 8/471; 8/532; 8/542; 8/589; 8/918

[58] Field of Search ..... 8/120, 129, 589, 542, 8/444, 478

[56] References Cited

U.S. PATENT DOCUMENTS 1,679,480 8/1928 Leemann et al. ..... 8/120
4,113,431 9/1978 Terada et al. ..... 8/120
4,142,853 3/1979 Terada et al. ..... 8/120
4,286,958 9/1981 Fujiu et al. ..... 8/471

FOREIGN PATENT DOCUMENTS 56-159381 12/1981 Japan .

*Primary Examiner*—A. Lionel Clingman
*Attorney, Agent, or Firm*—Bacon & Thomas

[57] ABSTRACT

The method involves treating a cellulose fiber-containing structure with an alkaline agent, coating the structure with an acid chloride having the following formula:

(wherein X is —H, —$NO_2$, —$CH_3$ or —$SO_2Cl$)

and subjecting the resultant structure to heat treatment to cause chemical modification. The acid chloride is employed in the form of an emulsion in water. The emulsion may also contain a thickener such as a natural sizing agent or a dye. The method provides a more dyeable cellulose fiber-containing structure.

9 Claims, 3 Drawing Figures

METHOD OF MODIFYING THE DYE AFFINITY OF CELLULOSE FIBER-CONTAINING STRUCTURE WITH BENZENE SULFONYL CHLORIDE

BACKGROUND OF THE INVENTION

1. Field of the Invention

The present invention relates to a method of modifying the dye affinity of a cellulose fiber-containing structure and, more particularly, to a method of modifying a cellulose fiber so as to be readily dyed with a dyestuff, particularly such as a disperse dye or an oil soluble dyestuff, which originally possesses less dye affinity for the cellulose fiber.

2. Description of the Prior Art

It is heretofore known that esterification of cellulose fibers can enhance their affinity for a dyestuff such as a disperse dye. The esterification with an acylating agent such as a benzoylating agent, however, impairs the water absorbency of the resulting modified cellulose fiber, a property that is originally present in cellulose fibers.

Further known, for instance, are three methods involving modifying cellulose fibers with a tosylating agent such as p-toluenesulfonyl chloride.

The first method is described in Example 4 in Japanese Laid-Open Patent Application No. 18,778/1975. In this method, a mercerized and bleached cotton fabric was first subjected to pretreatment which involves soaking it in a 50% (w/w) p-toluenesulfonyl chloride solution, squeezing the soaked fabric, allowing it to stand at room temperature for 24 hours, rinsing it with acetone, washing it with water and then drying it. The cotton fabric thus pretreated has a degree of substitution of 0.2 to 0.4. A paper substrate coated entirely with a sublimable disperse dye was then applied to the cotton fabric, and the dye was transferred by pressing at 200° C. for 20 seconds. This method, however, requires a long time for modification and imparts color to the modified cellulose fiber to only a slight extent with the disperse dye.

The second method is described in Example 7 in Great Britain Patent Specification No. 241,854. In this method, one kg. of mercerized cotton was immersed for half an hour in 10 kg. of a 14% alcoholic solution of caustic soda at 20° to 25° C. The fibres were then thoroughly centrifuged, and then immersed in 10 kg. of a 20% solution of para-toluosulphonic chloride in toluol at 40° to 45° C. in which solution they were worked about for an hour. This method, however, presents similar drawbacks as involved in the first method.

The third method is one proposed by the present inventors et al. and disclosed in Great Britain Patent Application Early Publication No. 2,035,386A. This method is a method of dyeing a fiber structure composed of a cellulose fiber or a blend of a cellulose fiber with a synthetic fiber, which comprises the steps of impregnating the fiber structure with an alkaline compound in an amount of from 1 to 20% by weight based on the weight of the fiber structure and with a modifying agent, the molar ratio of the alkaline compound to the modifying agent being from 0.1 to 2.0, and the modifying agent being a compound of the formula:

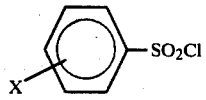

(wherein X is -H, $-NO_2$, $-CH_3$ or $-SO_2Cl$);

effecting the chemical modification of the impregnated fiber structure by heat-treating it under steaming or dry heating conditions; and then dyeing the modified fiber structure with a dye selected from the group consisting of a disperse dye, an oil-soluble dye, a mordant dye, and a basic dye. This method can provide a modified cellulose fiber with a dyeing property while retaining its original water absorbency. This method, however, requires a heat treatment, preferably by steaming, in order to provide a high quality modified fiber, so that additional equipment for steaming is required. As this method also requires the modifying agent to be used in solution in an organic solvent, it requires additional equipment for the organic solvent and the steaming step and an additional step of drying the organic solvent after using the modifying agent prior to the steaming step.

Other methods of chemically modifying cellulose employing p-toluenesulfonyl chloride are reported in, for example, The Journal of the American Chemical Society, vol. 72, pp. 670–674 (1959), Textile Research Journal, vol. 32, pp. 797–804 (1962), Textile Research Journal, vol. 33, pp. 107–117 (1963) and other literature. These methods, however, are industrially inappropriate because they require a long time for modification, or the use of a reagent which is difficult to handle.

SUMMARY OF THE INVENTION

Therefore, an object of the present invention is to provide a method of manufacturing a modified cellulose fiber which retains the water absorbency that is originally present in cellulose and which can be dyed with a disperse dye.

Another object of the present invention is to provide a method of modifying a cellulose fiber, which requires only a slight amount of an organic solvent.

A further object of the present invention is to provide a method of manufacturing a modified cellulose fiber similar to or better than those obtained by the process requiring the steaming step as disclosed in Great Britain Patent Application Early Publication No. 2,035,386A, said method further being capable of being carried out by any heating step.

A still further object of the present invention is to provide a method of modifying a cellulose fiber by heating without drying after the addition of the modifying agent.

A still further object of the present invention is to provide a method of modifying a cellulose fiber which is highly efficient.

In accordance with one aspect of the present invention, there is provided a process of modifying a cellulose fiber-containing structure comprising the steps of treating a cellulose fiber structure or a mixed structure of a cellulose fiber and a synthetic fiber with an alkaline agent, coating the treated fiber structure with an aqueous emulsion of an acid chloride baving the formula:

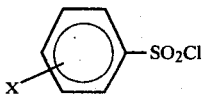

(wherein X is -H, $-CH_3$, $-NO_2$ or $-SO_2Cl$) and heating the fiber structure immediately thereafter.

DETAILED DESCRIPTION OF THE PREFERRED EMBODIMENTS

Figure 1:
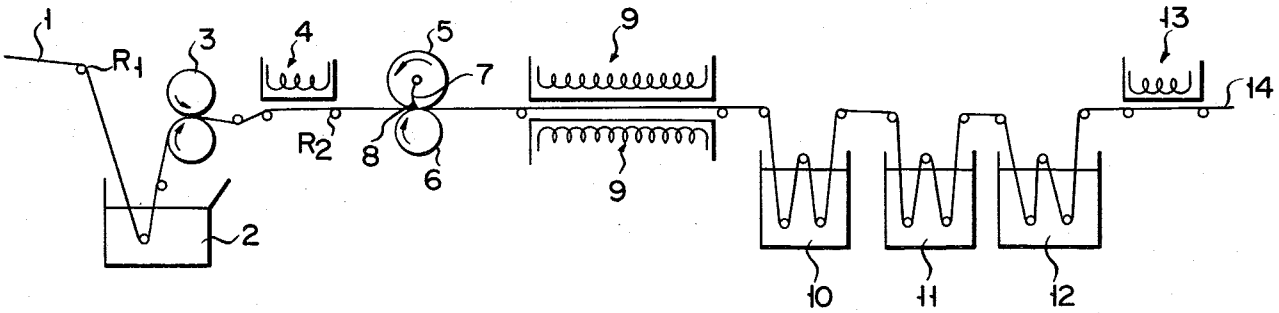
FIGS. 1 through 3 are schematic representations illustrating an apparatus for use in modifying the cellulose fiber-containing structure in accordance with the preferred embodiment of the present invention.

In accordance with the present invention, a cellulose fiber structure or a mixed structure of a cellulose fiber with a synthetic fiber is first treated with an alkaline agent and then subjected to heat treatment after being coated with an aqueous emulsion of an acid chloride.

1. Fibers

The cellulose fibers to be employed in accordance with the present invention may include natural cellulose fibers such as cotton fibers, regenerated cellulose fibers such as viscose rayon, and mixtures of these fibers with a synthetic fiber such as polyester. The fibers may be in the form of cloth or filaments.

2. Emulsions

The emulsion to be employed in the present invention contains the acid chloride having the formula:

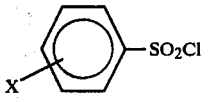

(wherein X is -H, $-NO_2$, $-CH_3$ or $-SO_2Cl$).

The acid chlorides may include, for example, p-toluenesulfonyl chloride, o-toluenesulfonyl chloride, o-nitrobenzenesulfonyl chloride, m-nitrobenzenesulfonyl chloride, p-nitrobenzenesulfonyl chloride, toluene-3,4-disulfonyl chloride or the like.

The emulsion may contain a thickener. The thickener may include, for example, a natural vegetable sizing agent, a natural animal sizing agent, a natural mineral sizing agent, a cellulose derivative, processed starch, processed natural rubber, a synthetic sizing agent or the like. The natural vegetable sizing agent may include starches from wheat flour, rice flour, rice sugar, corn or the like; natural rubbers such as tragacanth gum, gum arabic or the like; sea weed products such as funori, sodium alginate or the like. The animal sizing agent may include casein or the like, and the mineral sizing agent may be bentonite or the like. The cellulose derivative may be carboxymethyl cellulose; the processed starch may be roasted starch or the like; the processed natural rubber may include locust bean gum derivative or the like; and the synthetic syzing agent may include polyvinyl alcohol, polyvinyl acetate, vinyl acetate partially saponified material and derivatives of these. It is most preferable to use both the natural begetable sizing agent and bentonite. Bentonite can provide efficient chemical modification with much less reaction hindrance because it is inorganic and inactive in itself. It can also permit extremely favorable separation of surplus adhesion material after the chemical modification. Bentonite is also extremely simple to handle because it sediments.

The emulsion to be employed in accordance with the present invention may contain a surface active agent.

The step of preparing the emulsion may be conventional. For example, the acid chloride may be dissolved in an organic solvent such as toluene or the like having a high solvency, and the resulting mixture may be emulsified in a usual manner. Where the acid chloride is in liquid form at room temperature, it may conveniently be emulsified directly in water.

The emulsion may, as necessary, contain a dyestuff and/or a fiber crosslinking agent. The dyestuff to be employed will be described in more detail under item 6 "Dyeing" below, and the fiber crosslinking agent will also be described in more detail hereinbelow under item 8 "Crosslinking Treatment."

3. Alkaline Agents

The alkaline agent to be employed in the present invention is of strong alkalinity in nature and may include hydroxide of alkali metals or alkaline earth metals such as lithium, sodium, potassium, beryllium, magnesium, calcium, barium, strontium or the like. It is preferable to use a mixture of a strong alkali with a weak alkali, such as a mixture of sodium hydroxide with sodium hydrogen carbonate.

4. Treatment with Alkaline Agents and Emulsion

The alkaline agent may be applied to the fiber structure in an arbitrary manner. For example, the alkaline agent can be applied by immersing the fiber structure in an alkaline aqueous solution.

The emulsion may be applied by coating in numerous manners such as the roll coat system, the spray coat system, the air knife coat system, the flow coat system, the gravure coat system, the rotary screen coat system or the like.

In accordance with the present invention, the alkaline agent and then the emulsion are applied to the fiber structure. After it is treated with the alkaline agent, the fiber structure may be merely squeezed with a squeeze roll. Drying may or may not be conducted.

In accordance with the present invention, it is of significance to heat the cellulose fiber structure while water is still retained thereby.

5. Heating

It is necessary to heat the cellulose fiber structure immediately after it is treated with the emulsion, so that the moisture of the emulsion is retained prior to the heating treatment.

The step of heating may be conducted in an arbitrary manner, and the heating conditions may be mild.

For example, it is adequate to heat the fiber structure with a pintenter oven at 60° to 110° C. for 30 seconds to 5 minutes. The heating may be carried out by means of infrared radiation or microwave radiation.

With the microwave radiation, the heating can be conducted for a short period of time; the inner portion of the fiber structure can be uniformly heated; high heat efficiency can be provided without loss of heat to ambient air and a heating furnace, because the structure to be heated builds up heat within itself; and no damage is imparted to the fiber because of the short period of time required for heating. The treatment with the microwave radiation may be carried out with a well known microwave heating apparatus for 5 to 120 seconds.

6. Dyeing

The modified cellulose fibers obtainable by the process in accordance with the present invention can be dyed with a dyestuff which is or is not sublimable. Such a dyestuff may include a disperse dye, an oil soluble dye, a mordant dye, a basic dye, a vat dye or the like. The sublimable dyes may be dyed by means of the sublimable transfer printing method.

In instances where the emulsion contains a dye as set forth in item 2 "Emulsion" above, the fixing of the dye can also be effected simultaneously with the modification of the cellulose fiber. In this case, it is preferred to carry out the steaming step after the dyeing in order to assure the fixing of the dye.

Further, the modified fiber structure obtainable by the process in accordance with the present invention may be used in combination with other conventional methods. For instance, a modified cloth prepared by the methods as set forth hereinabove may be treated with a resin which can be dyed with a disperse dye, said resin including aminoalkyd resin, polyamide, urethane, vinyl chloride, vinyl acetate, polyester, acrylic resin, acetal, polyvinyl alcohol, vinylidene chloride, vinyl acetal, styrol, polycarbonate, epoxy resin or the like. Thereafter, dry transfer printing may be conducted to enhance the concentration, clearness of hue, contrast or the like.

7. Opal finishing

Generally, the cellulose fiber is treated with a 40 to 75% aqueous solution of sulfuric acid, aluminium sulfate, or sodium hydrogensulfate and heated, whereby the cellulose fiber is dissolved. The modified cellulose fiber obtained by the process in accordance with the present invention has a remarkably lower solubility rate than that of the unmodified cellulose fiber. In instances where a fiber structure comprising a cellulose fiber and a polyester fiber is partially chemically modified and the resulting fiber structure is thermally treated after the treatment with the 40 to 75% sulfuric acid, both the polyester fiber and most of the cellulose fiber remain undissolved in the modified portion of the fiber structure, while in the unmodified portion thereof, the polyester fiber remains undissolved and the cellulose fiber is dissolved substantially completely, because the modified portion differs in solubility rate from the unmodified portion to a remarkable extent. The portion where the cellulose fiber is dissolved forms a clear and transparent pattern. 8. Crosslinking Treatment The modified cellulose fiber obtainable by the process in accordance with the present invention can usually be crosslinked with a conventional crosslinking agent. The crosslinking agent may include, for example, dimethylol urea, dimethylol propylene urea, dimethylol dihydroxyethylene urea, dimethylol urone, trimethylol melamine, trimethoxymethyl melamine, hexamethoxymethyl melamine, dimethylol triazine, dimethyl hydroxyethyl triazine or the like. A catalyst to be employed for the crosslinking treatment may include, for example, an organic acid such as acetic acid, maleic acid or the like; an ammonium salt such as ammonium chloride, ammonium sulfate, diammonium hydrogenphosphate or the like; an amine such as ethanolamine hydrochloride, 2-amino-2-methylpropanol hydrochloride or the like; and magnesium chloride, zinc nitrate, zinc chloride, magnesium nitrate, zinc borofluoride, aluminum chloride, magnesium phosphate or the like.

As has been described above under the item 2 "Emulsions", where the emulsion contains the crosslinking agent, the crosslinking treatment can be carried out together with the chemical modification. Although hydrogen chloride is generated when an acid chloride reacts with the cellulose fiber, the hydrogen chloride can serve as a catalyst for crosslinking. Accordingly, where the crosslinking is effected concurrently with the chemical modification, a catalyst for crosslinking may not be needed or may be used in a small amount as compared with conventional approaches.

In accordance with the present invention, the acid chloride such as p-toluenesulfonyl chloride or the like is used in an emulsion in water so that, even if a cloth is in a wet state, it can be treated with the emulsion of the acid chloride in an extremely favorable manner and a wet-on-wet treatment can be conducted. This technique can omit the step of drying the cloth after the treatment with an alkali, thereby simplifying the process which is of great significance in practical production. The present invention permits the alkaline agent and the aqueous emulsion of the acid chloride such as p-toluenesulfonyl chloride or the like to treat the cloth in the wet-on-dry system or in the wet-on-wet system, so that the cloth can be treated with an appropriate amount of water together with the acid chloride. In the reaction of the cellulose with the acid chloride such as p-toluenesulfonyl chloride or the like, the process in accordance with the present invention can impart an affect equal to or better than that obtainable by the steaming treatment even when the dry heat treatment is effected, whereas the conventional approach provides a better effect when the steaming treatment is carried out as compared with that imparted by the dry heat treatment. Furthermore, in accordance with the process of the present invention in which the acid chloride such as p-toluenesulfonyl chloride or the like is used in an emulsion in water, the cellulose gets wet with the acid chloride in such a manner that the reaction of the fiber with the acid chloride can occur homogeneously, thereby reducing irregularities in dyeing. As hereinabove set forth, the process in accordance with the present invention presents advantages resulting in an improvement in generalization of a process for modification, a simplification of the modifying process, and uniformity of reaction.

In accordance with the processs of the present invention, in instances where microwaves are used as a source of heat for the reaction of the fiber cloth with the alkaline agent and the acid chloride, it enables the modification of the cellulose fiber with extremely high efficiency and in a short period of time as compared to the dry heat treatment or the steaming treatment conducted as in conventional approaches. That is, in instances where the fiber cloth treated with the alkaline agent and the acid chloride is placed in the electric field of a microwave, a molecule possessing a dipole such as water contained in the fiber oscillates rapidly about its axis of orientation by virtue of the electric field of the high frequency waves, so that the molecules collide with each other. Consequently, sufficient thermal energy is generated in an extremely short period of time to bring about the reaction quickly. In the process in accordance with the present invention, as the acid chloride is used in an emulsion in water, the effect resulting from the treatment can be enhanced all the more. That is, the fiber cloth is treated with the acid chloride in the emulsified state in water so that the reaction proceeds easily because an appropriate amount of water required for the reaction can be supplied and the material possessing a dipole requisite for heating by microwaves is automatically provided. Moreover, the acid chloride is employed in the emulsified state in water so that the solution is apparently rendered hydrophilic, whereby the problem of initiating reaction in the treating solution itself can be solved and workability can be improved to a great extent.

In the process in accordance with the present invention, the cellulose fiber-containing structure is treated in advance with the alkaline agent and then coated wholly or partially with a treating agent containing at least the acid chloride, the disperse dye and the thickener. The coated fiber structure is then subjected to the dry heat treatment or the steaming treatment to chemically modify the cellulose fiber portions of the structure so as to render them capable of being dyed with the disperse dye, and at the same time to complete the fixing of the disperse dye to the fiber structure to be dyed. Since the process of the present invention allows only the portions for dyeing to be treated with the chemicals such as the acid chloride or the like in the dyeing of the cellulose fiber-containing structure, the decrease in strength of the fiber is rendered remarkably small as compared to conventional techniques, and an extremely economical process is provided.

In accordance with the present invention, as the viscosity of the treating liquid containing the acid chloride can be adjusted without difficulty by varying the amount of the thickener, a conventional general printing machine such as a flat screen printing machine, a rotary screen printing machine or the like can be used without any adjustment of the machine, and a printed cloth of the cellulose fiber containing structure can be provided with the use of a disperse dye by means of similar printing techniques.

A description with reference to the drawings will be given of a continuous step process by which the present invention is carried out.

In instances where the apparatus as shown in FIG. 1 is applied, the process comprises the steps of treating a cellulose fiber structure with an alkaline agent, coating the fiber structure with an emulsion containing an acid chloride, subjecting it to heat treatment immediately after the coating step, and carrying out an after treatment such as washing with water.

A stock cloth 1 of cellulose fiber structure or a mixed structure of a cellulose fiber and a synthetic fiber is first fed over a lead roll $R_1$ into an alkaline bath 2, squeezed with a mangle 3 so as to render the amount of the alkaline agent uniform in the cloth, and then, if neccesary, dried with a dryer 4. The cloth 1 is then introduced through a lead roll $R_2$ into a rotary screen type coating apparatus by which the cloth is treated uniformly with an emulsion of an acid chloride in water. The coating apparatus includes a rotary screen 5, a back-up roll 6, a squeegee 7, and the aqueous emulsion 8 of the acid chloride to be supplied to the rotary screen. The aqueous emulsion of the acid chloride is provided on the cloth 1 through the rotary screen 5 by virtue of pressure applied by the squeegee 7 and the back-up roll 6. The cloth treated with the emulsion is then dried with a dryer or a dry heat oven 9 for curing over a predetermined period of time. The pre-treated cloth is then aftertreated in the order of washing with cold or warm water in a washing bath 10, soaping in a soaping bath 11, rinsing with water in a rinsing bath 12 and drying with a drying 13 to give a chemically modified cloth 14.

Figure 2:
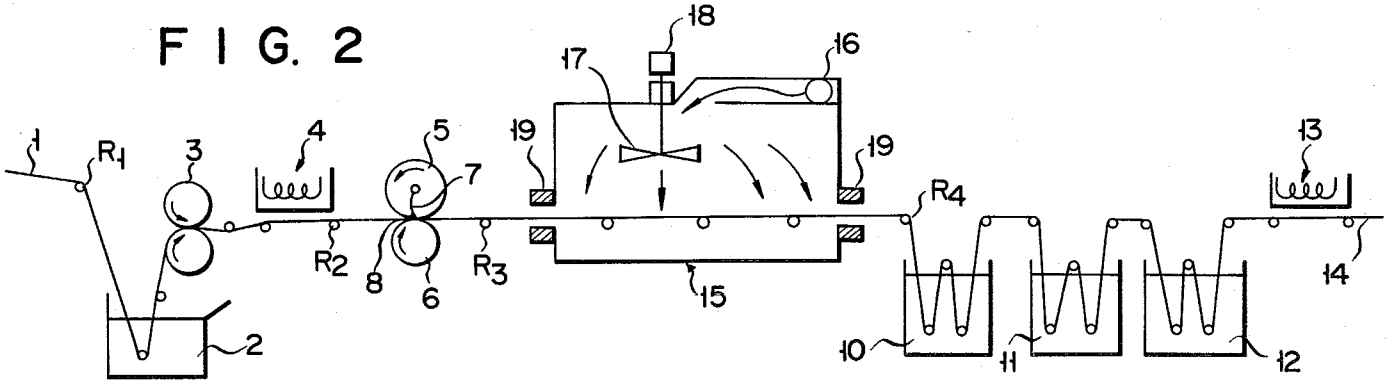

FIG. 2 illustrates an apparatus for carrying out a chemical modification of cellulose fibers by means of the microwave heating method. The stock cloth 1 comprising the cellulose fiber structure or mixed structure of cellulose fiber and synthetic fiber is introduced over the lead roll $R_1$ into the alkaline bath 2 for treating the cloth with an alkaline agent, and squeezed with the mangle 3 so as to provide a uniform amount of the alkaline agent in the cloth. The cloth is then dried with the dryer 4, if needed. The drying step can be omitted in the wet-on-wet system. The cloth is then introduced through the lead roll $R_2$ into the rotary screen type coating apparatus so as to treat the cloth uniformly with an aqueous emulsion of the acid chloride. The coating apparatus includes the rotary screen 5, the back-up roll 6, the squeegee 7 and the aqueous emulsion 8 of the acid chloride to be supplied to the rotary screen. The cloth 1 is treated through the rotary screen 5 by virtue of the pressure applied by the back-up roll 6 and the squeegee 7. The cloth treated with the aqueous emulsion of the acid chloride is then introduced through a lead roll $R_3$ into a microwave heating can body 15 in which the amount of microwave radiations required for the reaction is radiated on the cloth. The microwave heating can body 15 contains a microwave generator 16; a mode stirrer 17 for stirring the inner atomsphere therein so as to eliminate irregularities in the electric field, which is fixed in the can body 15; a motor 18 for rotating the mode stirrer; and filters 19 provided on the inlet and the outlet of the can body 9. The cloth 1 heated by the microwaves is then introduced through a lead roll $R_4$ into a set of aftertreating apparatuses comprising the washing bath 10 for washing with cold or warm water, the soaping bath 11 for soaping, and the rinsing bath 12 for rinsing with water. The cloth thus aftertreated is then introduced to the dryer 13 and dried to give the chemically modified cloth 14.

Figure 3:
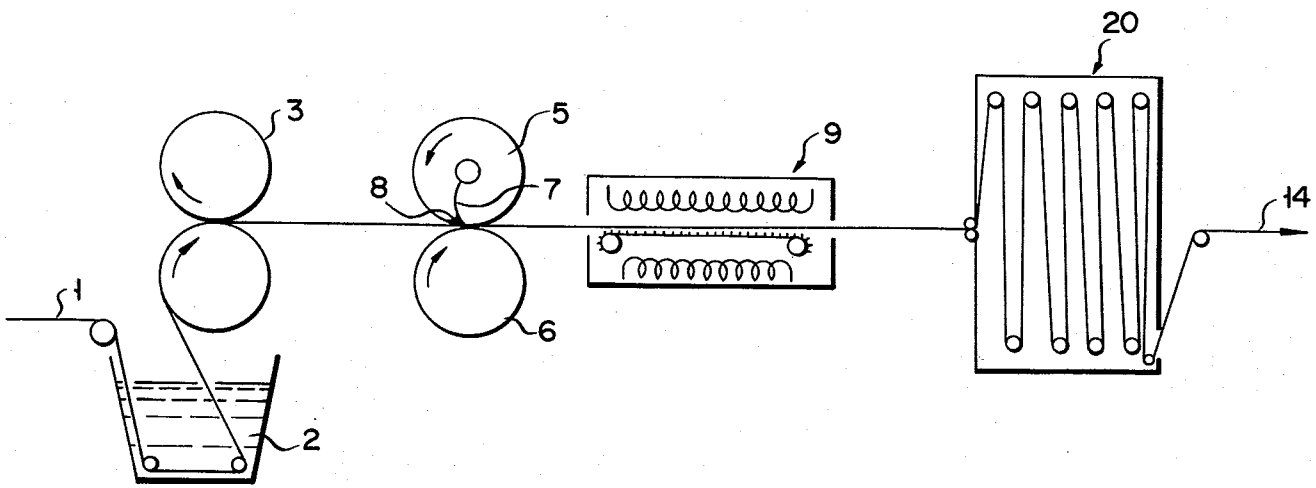

FIG. 3 illustrates an apparatus in which an emulsion containing a disperse dye is employed. In this apparatus, the stock cloth 1 is first introduced into the alkaline bath 2 for treatment with the alkaline agent and then squeezed with the mangle 3 so as to provide a uniform amount of the alkaline agent in the cloth. The cloth is then treated with an aqueous emulsion comprising at least an acid chloride, a disperse dye and a thickener in a rotary screen type coating apparatus. The coating apparatus includes the rotary screen 5, the back-up roll 6, the squeegee 7, and the aqueous emulsion 8 containing at least the acid chloride, the disperse dye and the thickener. In the apparatus, the cloth 1 is treated with the aqueous emulsion through the rotary screen 5 by virtue of the pressure applied by the back-up roll 6 and the squeegee 7.

The cloth 1 treated with the aqueous emulsion is then introduced into the dry heat oven 9 for further modification and then into a continuous loop steamer 20 which is a steaming apparatus. The cloth thus treated is then soaped, rinsed with water and dried to give a print cloth 14.

EXAMPLE 1

A mercerized blended broad cloth comprising polyester/cotten (65/35) was soaked in a 10% sodium hydroxide aqueous solution for 5 seconds and then squeezed with a mangle so as to provide a compression rate of 80%. The cloth was then treated continuously at the rate of 100 g/m$^2$ with an aqueous emulsion of p-toluenesulfonyl chloride having the composition below in the wet-on-wet system with a rotary screen as shown in FIG. 1.

| Composition | Parts by weight |
|---|---|
| p-toluenesulfonyl chloride | 25 |
| toluene | 35 |
| water | 40 |
| carboxymethyl cellulose | 0.5 |
| Nissan Nonion NS-206 (nonionic surface active agent; Nippon Yushi K.K.) | 2 |
| Nissan Nonion NS-210 (nonionic surface active agent; Nippon Yushi K.K.) | 2 |
| Nissan Nonion NS-220 (nonionic surface active agent; Nippon Yushi K.K.) | 2 |

The composition as hereinabove set forth was mixed homogeneously with a homomixer to give an emulsion.

The cloth treated with the emulsion was then dried at a temperature of 80° C. for 5 minutes in a dry heat oven and then washed with water. After being soaped with merseilles soap and rinsed with water, the cloth was dried to give a modified cloth.

The resulting modified cloth was subjected to transfer printing with dry transfer printing paper using a sublimable disperse dye at a pressure of 150 g/cm$^2$ at 195° C. for 35 seconds whereby a print cloth of good appearance was produced.

EXAMPLE 2

A mercerized blended broad cloth comprising polyester/cotton (65/35) was immersed in a 8% sodium hydroxide aqueous solution for 10 seconds and squeezed with a mangle so as to provide a compression rate of 90%. The cloth was dried at 110° C. in a pin-tenter oven for 40 seconds and then treated at the rate of 75 g/m$^2$ with an aqueous emulsion of o-toluenesulfonyl chloride having the composition below with a rotary screen having 40 lines per inch, a nickel plate thickness of 150$\mu$ and an opening rate of 50%.

| Composition | Parts by weight |
|---|---|
| o-toluenesulfonyl chloride (containing 27% p-toluenesulfonyl chloride) | 40 |
| toluene | 10 |
| water | 50 |
| carboxymethyl cellulose | 1 |
| Nissan Nonion NS-206 | 2 |
| Nissan Nonion NS-210 | 2 |
| Nissan Nonion NS-220 | 2 |

The mixture having the above composition was emulsified with a homomixer to give an aqueous emulsion of o-toluenesulfonyl chloride. The molar ratio of sodium hydroxide to o-toluenesulfonyl chloride on the cloth was 1:1.22.

The cloth was introduced into a continuous microwave heating apparatus containing a generator having a frequency of 2,450 MHz and a power of 2 kW and heated with microwaves for 30 seconds. After washing with water, soaping with merseilles soap and washing with water, the cloth was dried to give a modified cloth.

A transfer paper was prepared by gravure printing at the rate of 60 g/m$^2$ with an ink having the composition below on paper with one side coated with starch.

| Composition | Parts by weight |
|---|---|
| Sumikalon Red E-FBL (bulk) (SUMITOMO CHEMICAL CO., LTD.) | 10 |
| Ethyl cellulose N-7 (Hercules, Inc) | 9 |
| surface active agent | 1 |
| isopropyl alcohol | 40 |
| ethanol | 40 |

The transfer paper was superposed on the modified cloth and subjected to transfer printing at a temperature of 195° C. and a pressure of 300 g/cm$^2$ for 40 seconds, whereby a print cloth having identical density of red color on both the polyester and the cotton portion was obtained.

EXAMPLE 3

A mercerized blended broad cloth comprising polyester/cotton (65/35) was immersed in a 10% sodium hydroxide aqueous solution for 5 seconds and then squeezed with a mangle so as to provide a compression rate of 80%. Using a rotary screen as used in Example 1, the cloth was continuously treated at the rate of 100 g/m$^2$ with an aqueous emulsion of p-toluenesulfonyl chloride having the composition below in the wet-on-wet system.

| Composition | Parts by weight |
|---|---|
| p-toluenesulfonyl chloride | 25 |
| toluene | 35 |
| water | 40 |
| carboxymethyl cellulose | 0.5 |
| Nissan Nonion NS-206 | 2 |
| Nissan Nonion NS-210 | 2 |
| Nissan Nonion NS-220 | 2 |

The mixture having the above composition was emulsified with a homomixer to give the aqueous emulsion.

The cloth treated with the aqueous emulsion was then introduced into a microwave heating apparatus as used in Example 2 and treated with microwaves for 30 seconds. After washing with water, soaping with merseilles soap and washing with water, the cloth was dried to give a modified cloth.

The modified cloth thus prepared was subjected to transfer printing with a dry transfer printing paper at a pressure of 150 g/cm$^2$ at 195° C. for 35 seconds to give a print cloth of good appearance.

EXAMPLE 4

A modified cloth was prepared in the same manner as in Example 2 and immersed in a solution having the composition below.

| Composition | Parts by weight |
|---|---|
| Sumitex Resin AMH 3000 (SUMITOMO CHEMICAL CO., LTD. acrylic acid ester emulsion) | 10 |
| Sumitex Accelerator X-80 (SUMITOMO CHEMICAL CO., (LTD.) | 1 |
| water | 90 |

After the cloth was squeezed to a compression rate of 80% and predried at 100° C. for 2 minutes, the cloth was baked at 150° C. for 3 minutes.

A transfer paper was prepared in the same manner an in Example 2.

The transfer paper thus prepared was superposed on the modified cloth, and the transfer was carried out at a temperature of 195° C. under a pressure of 300 g/cm$^2$ for 40 seconds, whereby a print cloth was given with the polyester and cotton portions having the identical red density, brightness and deepness. The cloth was measured for its washing fastness and determined as the fifth grade by the (A-2) method. It was thus found that the print cloth was fast to washing. The transferred print clothes which had been treated with the resin and which had not been treated therewith were measured for their color-developing density with a Macbeth reflective densitometer, and the former was found to be 1.32 and the latter was found to be 1.27. This result indicates an increase in density with the resin treatment.

EXAMPLE 5

A modified cloth was prepared in the same manner as in Example 2 and then immersed in a solution having the composition below:

| Composition | Parts by weight |
|---|---|
| Sumitex Resin NS-16 (SUMITOMO CHEMICAL CO., LTD.) | 10 |
| Sumitex Accelerator X-80 | 1 |
| Sumitex Softner L (SUMITOMO CHEMICAL CO., LTD.) | 1 |
| water | 90 |

The cloth was then squeezed to a compression rate of 80%, pre-dried at 100° C. for 2 minutes and baked at 150° C. for 3 minutes.

A transfer paper was prepared in the same manner as in Example 2.

The transfer paper thus prepared was superposed on the modified cloth, and the transfer was carried out at a temperature of 200° C. under a pressure of 300 g/cm$^2$ for 40 seconds, whereby a print cloth was given which had the identical red density on both the polyester and cotton portions and a favorable feeling.

EXAMPLE 6

A mercerized blended broad cloth comprising polyester/cotton (65/35) was immersed in a 10% sodium hydroxide aqueous solution and squeezed to a compression rate of 90% with a mangle. The fiber cloth was treated with an aqueous emulsion having the composition below through a rotary screen having 40 lines per inch, a nickel plate thickness of 150$\mu$ and an opening ratio of 50%.

| Composition | Parts by weight |
|---|---|
| o-toluenesulfonyl chloride | 25 |
| toluene | 25 |
| water | 50 |
| sodium alginate | 1 |
| bentonite | 2 |
| Nissan Nonion NS-206 | 1.5 |
| Nissan Nonion NS-210 | 1.5 |
| Nissan Nonion NS-220 | 1.5 |

After the treated cloth was dry heat treated at 80° C. for 90 seconds in a pintenter oven, the cloth was soaped with merceilles soap, washed with warm water and then with cool water and dried to give a modified cloth.

A transfer paper was prepared by gravure printing at the rate of 60 g/m$^2$ with an ink having the composition below on paper with one side coated with starch.

| Composition | Parts by weight |
|---|---|
| Sumikalon Red E-FBL Bulk | 10 |
| ethyl cellulose N-7 | 9 |
| surface active agent | 1 |
| isopropyl alcohol | 40 |
| ethyl alcohol | 40 |

The transfer paper thus prepared was superposed on the modified cloth, and the transfer printing was carried out at a temperature of 195° C. under a pressure of 300 g/cm$^2$ for 40 seconds, whereby a print cloth was prepared with the polyester fiber and the cotton portions having the identical red density.

EXAMPLE 7

A mercerized blended broad cloth comprising polyester/cotton (65/35) was immersed in a 10% sodium hydroxide aqueous solution and squeezed to a compression rate of 90% with a mangle. The resulting fiber cloth was treated with an aqueous emulsion having the composition below through a rotary screen as used in Example 6;

| Composition | Parts by weight |
|---|---|
| o-toluenesulfonyl chloride | 10 |
| p-toluenesulfonyl chloride | 15 |
| toluene | 25 |
| water | 50 |
| sodium alginate | 1 |
| bentonite | 2 |
| Nissan Nonion NS-206 | 1.5 |
| Nissan Nonion NS-210 | 1.5 |
| Nissan Nonion NS-220 | 1.5 |

After the treated cloth was subjected to dry heat treatment at 100° C. for 30 seconds in a pintenter oven, the resulting cloth was soaped with merceilles soap, washed with warm water and then with cool water and dried well to give a modified cloth.

Using a dry transfer printing paper, the modified cloth thus prepared was subjected to transfer printing at 195° C. under a pressure of 150 g/cm$^2$ for 35 seconds whereby a print cloth of good appearance was given.

The following is the description of the examples wherein an emulsion containing a disperse dye is employed.

EXAMPLE 8

A mercerized blended broad cloth comprising polyester/cotton (65/35) was immersed in an 8% sodium hydroxide aqueous solution for 10 seconds and squeezed with a mangle to a compression rate of 90%.

The resultant cloth was then subjected to patterning treatment with an aqueous emulsion of o-toluenesulfonyl chloride having the composition below through a rotary screen having 40 lines per inch, a nickel plate thickness of 150$\mu$ and an opening ratio of 50%.

| Composition | Parts by weight |
|---|---|
| o-toluenesulfonyl chloride | 25 |
| toluene | 25 |
| water | 50 |
| sodium alginate | 1 |

-continued

| Composition | Parts by weight |
|---|---|
| bentonite | 2 |
| C.I. Disperse Red 181 | 5 |
| Nissan Nonion NS-206 | 2 |
| Nissan Nonion NS-210 | 2 |
| Nissan Nonion NS-220 | 2 |

The mixture having the above composition was emulsified with a homomixer to give an aqueous emulsion of o-toluenesulfonyl chloride. The cloth treated with the aqueous emulsion was then dried at 80° C. for 90 seconds in a pintenter oven.

The cloth was further treated by steaming with superheated stream having a temperature of 170° C. for 10 minutes. After usual soaping and washing with water, the cloth was then dried to give a print cloth having an identical red density on both the polyester and cotton portions of the patterned part and an extremely favorable color fastness.

EXAMPLE 9

A mercerized blended board cloth comprising polyester/cotton (65/35) was immersed in an 8% sodium hydroxide aqueous solution for 10 seconds and then squeezed to a compressibility of 90% with a mangle.

The cloth was printed with a multiplicity of colors through a flat screen having 150 lines with three kinds of aqueous emulsions having the following compositions:

| Composition of Emulsion 1 | Parts by weight |
|---|---|
| o-toluenesulfonyl chloride | 25 |
| toluene | 25 |
| water | 50 |
| sodium alginate | 1 |
| bentonite | 2 |
| C.I. Disperse Red 181 | 5 |
| Nissan Nonion NS-206 | 2 |
| Nissan Nonion NS-210 | 2 |
| Nissan Nonion NS-220 | 2 |

EMULSION 2

C.I. Disperse Violet 56 was employed in the amount of 5 parts by weight in place of C.I. Disperse Red 181 in the composition of Emulsion 1.

EMULSION 3

C.I. Disperse Blue 52 was employed in the amount of 5 parts by weight in place of C.I. Disperse Red 181 in the composition of Emulsion 1.

After it was dried at 80° C. for 90 seconds with a pintenter oven, the cloth was subjected to steaming heat treatment at 170° C. for 5 minutes with an HT steamer. The cloth was then soaped in a usual manner, washed with water and dried to give a print cloth having an identical density hue on both the polyester and the cotton portions of the pattern part and an extremely favorable color fastness.

The following example illustrates an example of processing.

EXAMPLE 10

A mercerized blended broad cloth comprising polyester/cotton (65/35) was immersed in a 10% sodium hydroxide aqueous solution and then squeezed to a compressibility of 90% with a mangle.

The cloth was then subjected to printing with an aqueous emulsion having the composition below through a rotary screen with a pattern having 40 lines per inch, a nickel plate thickness of 150μ and an opening ratio of 50% on a non-pattern portion (a).

| Composition | Parts by weight |
|---|---|
| p-toluenesulfonyl chloride | 60 |
| toluene | 140 |
| water | 145 |
| Nissan Nonion NS-206 | 5 |
| Nissan Nonion NS-210 | 5 |
| Nissan Nonion NS-230 | 5 |
| sodium alginate | 2 |
| bentonite | 5 |

The cloth was thereafter heated at 100° C. for 90 seconds in a pintenter oven, soaped and washed with water to give a patterned modified cloth.

The patterned modified cloth was immersed in a 60% sulfuric acid aqueous solution for 30 seconds and dried at room temperature. After heating at 100° C. for 60 seconds, the cloth was washed with water while mechanically crumpling and dried to give a clear and transparent pattern on a non-modified portion, that is, a pattern portion (b) shown in FIG. 1.

The resultant cloth was then dyed with a dyeing bath having the composition below in an autoclave having a bath ratio of 1/30 at 130° C. for 20 minutes, whereby a dyed cloth having a uniform density was given.

| Composition | Amount |
|---|---|
| Sumikalon Blue E-FBL (SUMITOMO CHEMICAL CO., LTD.) | 30 g |
| water | 1 liter |

The following example illustrates an emulsion containing a crosslinking agent.

EXAMPLE 11

A mercerized blended broad cloth comprising polyester/cotton (50/50) was immersed in a 10% sodium hydroxide aqueous solution and then squeezed to a compressibility of 90%. After it was dried at 100° C. for 30 seconds, the cloth was coated with an aqueous emulsion having the following composition through a rotary screen having 40 lines per inch, a nickel plate thickness of 150μ and an opening ratio of 50%.

| Composition | Parts by weight |
|---|---|
| p-toluenesulfonyl chloride | 60 |
| toluene | 140 |
| water | 145 |
| Sumitex Resin NS-19 (SUMITOMO CHEMICAL CO., LTD.; dimethylol hydroxyethylene urea) | 30 |
| Nissan Nonion NS-206 | 5 |
| Nissan Nonion NS 210 | 5 |
| Nissan Nonion NS-230 | 5 |
| sodium alginate | 2 |
| bentonite | 5 |

The cloth was then dried at 140° C. for 90 seconds in a pintenter oven, soaped and washed with water to give a modified cloth having a favorable resistance to crinkling.

The modified cloth was dyed with a dyeing bath having the following composition in an autoclave with a bath ratio of 1/30 at 130° C. for 20 minutes to give a dyed cloth having an extremely good level-dyeing property, color fastness and resistance to crinkling.

| Composition | Amount |
|---|---|
| Sumikalon Blue E-FBL | 30 g |
| water | 1 liter |

What we claim is:

1. A method of modifying the dye affinity of a cellulose fiber-containing structure, comprising the steps of treating a cellulose fiber structure or a mixed structure of a cellulose fiber and a synthetic fiber with an alkaline agent, coating the structure with an aqueous emulsion of an acid chloride having the formula:

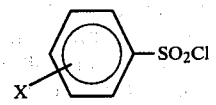

(wherein X is —H, —$NO_2$, —$CH_3$ or —$SO_2Cl$) and subjecting the coated structure to heat treatment prior to drying of the emulsion to cause chemical modification.

2. A method according to claim 1, wherein the heat treatment is carried out by microwave heating.

3. A method according to claim 2, wherein the microwave heating is carried out for 5 to 120 seconds.

4. A method according to claim 1, wherein the emulsion contains the acid chloride, a disperse dye and a thickener.

5. A method according to claim 4, wherein the thickener is an animal, vegetable or mineral sizing agent.

6. A method according to claim 1, wherein the emulsion contains the acid chloride, a vegetable natural sizing agent, bentonite and a nonionic surface active agent.

7. A method according to any one of claims 1 to 3 and 6, wherein treatment with a resin capable of being dyed with a disperse dye is further carried out after the chemical modification.

8. A method according to any one of claims 1 to 3 and 6, wherein treatment with a fiber crosslinking agent and a crosslinking catalyst is carried out after the chemical modification.

9. A method according to any one of claims 1 to 6, wherein the fiber structure is partially chemically modified and subjected to heat treatment with a 40 to 75% sulfuric acid solution, whereby the chemically unmodified portion thereof is dissolved substantially completely to give a transparent pattern.

* * * * *